US010414551B2

(12) United States Patent
Martini et al.

(10) Patent No.: US 10,414,551 B2
(45) **Date of Patent: *Sep. 17, 2019**

(54) LID FOR AN OPENING DEVICE

(71) Applicant: TETRA LAVAL HOLDINGS & FINANCE S.A., Pully (CH)

(72) Inventors: Pietro Martini, Parma (IT); Livio Veronesi, San Felice sul Panaro (IT); Franco Cani, Asti (IT); Ivan Orlandi, Savignano sul Panaro (IT); Domenico Didonna, Modena (IT); Massimiliano Cereda, Modena (IT); Davide Corradi, Soliera (IT); Rocco De Paola, Modena (IT); Diego Cavanna, Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 137 days.

This patent is subject to a terminal disclaimer.

(21) Appl. No.: 15/527,875

(22) PCT Filed: Oct. 28, 2015

(86) PCT No.: PCT/EP2015/074920

§ 371 (c)(1),
(2) Date: May 18, 2017

(87) PCT Pub. No.: WO2016/083052

PCT Pub. Date: Jun. 2, 2016

(65) Prior Publication Data

US 2018/0327146 A1 Nov. 15, 2018

(30) Foreign Application Priority Data

Nov. 25, 2014 (EP) ..... 14194720

(51) Int. Cl.
*B65D 41/04* (2006.01)
*B65D 41/34* (2006.01)

(52) U.S. Cl.
CPC ..... *B65D 41/0485* (2013.01); *B65D 41/3428* (2013.01); *B65D 2251/023* (2013.01)

(58) Field of Classification Search
CPC ..... B65D 41/0485; B65D 41/3428; B65D 2251/023

(Continued)

(56) References Cited

U.S. PATENT DOCUMENTS 4,103,798 A * 8/1978 Moeller ..... B65D 41/02 215/200
5,184,740 A * 2/1993 Mandrell, II ..... B65D 51/1683 215/305

(Continued)

FOREIGN PATENT DOCUMENTS

DE 578273 C 6/1933

OTHER PUBLICATIONS

International Search Report, dated Jan. 18, 2016, from corresponding PCT Application No. PCT/EP2015/074920.

*Primary Examiner* — James N Smalley
(74) *Attorney, Agent, or Firm* — Young & Thompson

(57) ABSTRACT

A lid for an opening device for a container includes a body having a longitudinal axis and provided with a top wall and with a side wall internally provided with a thread element suitable for cooperating with a further thread element of a spout of the opening device, the lid further including at least one driving element arranged to receive the fingers of a user during unscrewing of the lid from the spout and during screwing of the lid on the spout, the at least one driving element being delimited by an upper wall and by a lower wall extending from the side wall and spaced apart from each other along the longitudinal axis, the lower wall diverging from the upper wall when moving away from the side wall.

20 Claims, 6 Drawing Sheets

(58) Field of Classification Search
USPC ..... 215/305
See application file for complete search history.

(56) References Cited

U.S. PATENT DOCUMENTS

| | | | | | |
|---|---|---|---|---|---|
| D351,793 | S | * | 10/1994 | Stoller | D9/443 |
| 5,941,404 | A | | 8/1999 | Charrette | |
| D621,706 | S | * | 8/2010 | Breckan | D9/443 |
| 2015/0129533 | A1 | * | 5/2015 | Taber | B65D 75/5883 215/252 |

* cited by examiner

LID FOR AN OPENING DEVICE

TECHNICAL FIELD

The present invention relates to a lid for an opening device for a container, in particular for a sealed container for packaging pourable food products.

BACKGROUND OF INVENTION

As known, many pourable food products, such as fruit juice, UHT (ultra-high-temperature treated) milk, wine, tomato sauce, etc., are sold in containers made of sterilized sheet packaging material.

A typical example of this type of container is the parallelepiped-shaped container for liquid or pourable food products known as Tetra Brik Aseptic (registered trademark), which is made by folding and sealing laminated sheet packaging material.

The packaging material has a multilayer structure substantially comprising a base layer for stiffness and strength, which may comprise a layer of fibrous material, e.g. paper, or mineral-filled polypropylene material, and a number of lamination layers of heat-sealable plastic material, e.g. polyethylene films, covering both sides of the base layer.

In the case of aseptic containers for long-storage products, such as UHT milk, the packaging material also comprises a layer of gas-barrier material, e.g. aluminium foil or ethyl vinyl alcohol (EVOH) film, which is superimposed on a layer of heat-sealable plastic material, and is in turn covered with another layer of heat-sealable plastic material forming the inner face of the container eventually contacting the food product.

Containers of this sort are normally produced on fully automatic packaging machines, on which a continuous tube is formed from the web-fed packaging material. The web of packaging material is sterilized in the packaging machine. The web of packaging material so sterilized is then maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, containers.

Alternatively, the packaging material may be cut into blanks, which are formed into containers on forming spindles, and the containers are filled with the food product and sealed. One example of this type of container is the so-called "gable-top" container known by the trade name Tetra Rex (registered trademark).

To open the containers described above, various solutions have been proposed, including reclosable opening devices made of plastic material and substantially comprising a pouring spout, defining a through pouring opening and fitted to a wall of the container.

When producing the opening device, the opening of the pouring spout is sealed by a closing element connected integrally to the pouring spout and detachable from it along a smaller-section annular tearable membrane; the closing element extends at the same level as the packaging material so as to seal the hole in the wall of the container.

According to a known embodiment, the pouring spout and the closing element are injection molded in one piece directly on a through hole formed in the packaging material so as to seal it.

In particular, the portion of the packaging material provided with the hole on which the pouring spout and the closing element are to be formed is placed between two molds in an open configuration. The molds are then displaced towards the packaging material to reach a closed configuration, in which they cooperate with opposite faces of the packaging material and define a closed mold cavity housing the above-mentioned hole. The injection molding operation is performed by injecting the molten plastic material in the mold cavity defined by the molds in the closed configuration. More specifically, the molten plastic material is forced to fill completely the mold cavity so as to form the pouring spout and the closing element.

Subsequently, a lid is fitted to the pouring spout.

According to another known embodiment the pouring spout and the closing element are injection molded in one piece directly on a so-called "prelaminated" hole of the packaging material, i.e. a hole formed in the base layer only and covered by the other lamination layers, including the layer of gas-barrier material. The plastic material is injection molded on a first side of the "prelaminated" hole. The plastic material forms the closing portion on one side of the "prelaminated" hole and pierces the "prelaminated" hole along a circumferential region thereof, so forming a circumferential passage. The plastic material, therefore, flows through the circumferential passage and forms the pouring spout on a second side—opposite to the above-mentioned first side—of the "prelaminated" hole. After the molding operation, the lamination layers, in particular the layer of gas-barrier material, are integrated into the closing element and enhances the barrier properties, in particular the gas (oxygen) barrier properties, of the closing element.

A removable screw lid is fitted to the pouring spout to outwardly closing the latter and allowing closure of the container after the first opening by removing the closing element.

First opening of the package requires an unscrewing torque in an unscrewing direction, whilst re-closing of the package after first opening requires a screwing torque in a screwing direction, opposite to the unscrewing direction.

The unscrewing torque is greater than the screwing torque.

A drawback of the known opening devices is that the user can pull the lid—instead of unscrewing it—and therefore damage the opening devices.

Another drawback of the known opening devices is that if the user does not pay attention, he may apply a too high screwing torque—when re-closing the package—and so damage the opening device.

Another drawback of the known opening devices is that it may not be clear to the user which the unscrewing direction is. The user therefore, can unscrew the lid from the pouring spout by rotating the lid in the wrong direction and so break the opening device.

DISCLOSURE OF INVENTION

It is an object of the invention to improve the known opening devices.

It is another object of the invention to provide an opening device in which the risk that the user pulls the lid from the pouring spout, instead of unscrewing it, is reduced.

It is another object of the invention to provide an opening device which is not over-screwed onto the pouring spout during re-closing of the package.

It is another object of the invention to provide an opening device that gives to the user a clear indication of the unscrewing direction and screwing direction.

According to the invention, there is provided a lid for an opening device as claimed in claim 1.

BRIEF DESCRIPTION OF THE DRAWINGS

Some preferred, non-limiting embodiments of the invention will be described by way of example with reference to the accompanying drawings, in which.

DETAILED DESCRIPTION OF PREFERRED EMBODIMENTS

Figure 1:
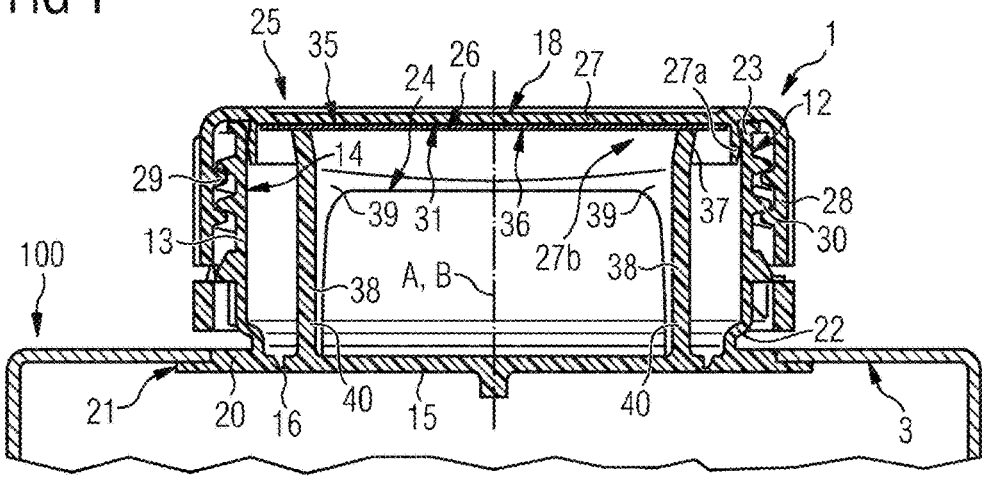
FIG. 1 shows an axial section of an opening device having a lid according to the invention and applied on a sectioned receiving portion of a sheet packaging material forming a container.

With reference to FIGS. 1 to 8, number 1 indicates as a whole a reclosable opening device for a container 100, in particular a sealed container for packaging pourable food products.

In the example shown, the opening device 1 is applied to a receiving portion 2 of a multilayer sheet packaging material 3, in turn folded, filled with a pourable food product and sealed in a known manner to form the container 100.

Figure 2:
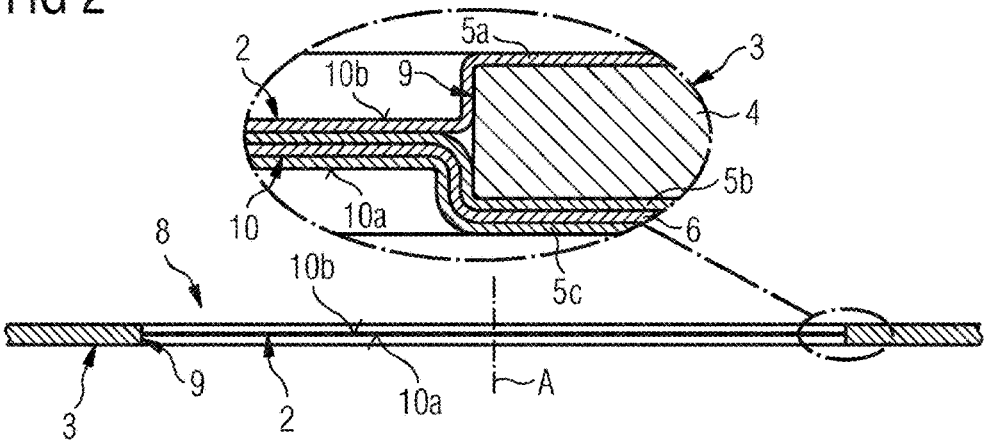
FIG. 2 shows a larger-scale section of the sheet packaging material of FIG. 1 before the opening device is applied thereto.

With particular reference to FIG. 2, the packaging material 3 comprises a base layer 4 for stiffness and strength, which may be made of fibrous material, e.g. paper, or mineral-filled polypropylene material, and a first layer 5*a* of heat-sealable plastic material, e.g. polyethylene films, and a second layer of heat-sealable plastic material 5*b*, e.g. polyethylene films, covering both sides of the base layer 4.

In the case of an aseptic container for long-storage products, such as UHT milk, the packaging material 3 also comprises a barrier layer 6 of gas-barrier material, e.g. aluminium foil or ethyl vinyl alcohol (EVOH) film, which is superimposed on the second layer 5*b* of heat-sealable plastic material, and is in turn covered with a third layer 5*c* of heat-sealable plastic material forming the inner face of the container eventually contacting the food product.

In other words, the first layer 5*a*, the second layer 5*b*, the third layer 5*c* and the barrier layer 6 define respective lamination layers applied to the base layer 4 when producing packaging material 3 in the form of a continuous strip.

In the example shown, the receiving portion 2 is defined by a so-called pre-laminated hole, i.e. a hole 9 formed through the base layer 4 and covered by the lamination layers, i.e. the first layer 5*a*, the second layer 5*b*, the third layer 5*c* and the barrier layer 6, so that the hole 9 is sealed by a sheet cover portion 10.

In a possible alternative embodiment not shown, the cover portion 10 may even be defined by only one or some of the lamination layers. For example, the cover portion 10 may be made solely of gas-barrier material.

In another possible alternative embodiment not shown, the cover portion 10 may be defined by a patch fixed to the rest of the packaging material 3 to seal a hole formed, in this case, through the full thickness of such packaging material 3.

In a further alternative embodiment not shown, the receiving portion 2 may be simply defined by a hole formed through the full thickness of the packaging material 3 and which is destined to be sealed by opening device 1.

With reference to FIG. 1, the opening device 1 has an axis A, which in use is substantially perpendicular to the receiving portion 2.

The opening device 1 comprises a pouring spout 12 fixed to the packaging material 3 at the hole 9 and having a tubular neck 13 of axis A, defining a pouring opening 14, by which to pour in use the content of the container.

The opening device 1 further comprises a closing element 15 closing or sealing the pouring opening 14 and integrally connected to the pouring spout 12 by a smaller-section, annular membrane 16 adapted to be easily torn in use.

The opening device 1 further comprises a lid 18 fitted to the neck 13 of the pouring spout 12 in a removable manner to close or seal the pouring opening 14 at a region thereof different from that closed by the closing element 15.

The lid 18 has a longitudinal axis B that corresponds to axis A, when the lid 18 is fitted to the neck 13.

The annular membrane 16 defines a tear line along which to detach in use the closing element 15 from the pouring spout 12.

According to an embodiment, the pouring spout 12 and the closing element 15 are formed in one piece on the receiving portion 2 of the packaging material 3, whilst the lid 18 is formed separately from the pouring spout 12 and the closing element 15 and then fitted thereto.

In the embodiment disclosed in FIGS. 1 to 4, the pouring spout 12 and the closing element 15 are obtained by molding molten plastic material, for example by an injection molding operation carried out on the packaging material 3 before the packaging material 3 is folded to obtain the container 100.

More specifically, the plastic material destined to form the pouring spout 12 and the closing element 15 is injected in a molten state onto a first side 10*a*—i.e. the side eventually facing inwards of the final container—of the cover portion 10 placed in a known manner within a molding apparatus (known per se and not shown). In particular, the molten plastic material covers the side 10*a* of the cover portion 10 up to an annular peripheral region thereof so as to form, in this way, the closing element 15 directly attached to the cover portion 10. The molten plastic material is then forced to pierce the cover portion 10 at such annular peripheral region to form the pouring spout 12 projecting from a second side 10*b* of the cover portion 10. The second side 10*b* is opposite to the first side 10*a*. The second side 10*b* is the side eventually facing outwards of the final container 100.

The pouring spout 12 is attached to the closing element 15 through the smaller-section annular membrane 16, which is in turn adapted to be torn by the user to open the container 100.

In this way, the material forming the pre-laminated hole is first pierced through and then resealed by the plastic material forming the pouring spout 12.

In practice, the neck 13 of pouring spout 12 extends through the cover portion 10 as a follow-on from the piercing thereof so as to be arranged on both the first side 10*a* and the second side 10*b* of the cover portion 10.

The closing element 15 and the cover portion 10 together define a sealing portion that seals the pouring opening 14 of the pouring spout 12. The closing element 15 substantially has a confetti shape.

According to a possible alternative not shown, the plastic material intended to form the pouring spout 12 and the closing element 15 may be also directly injected in a molten state through a hole of the packaging material 3 so that such hole is then completely sealed by the closing element 12 only.

Figure 3:
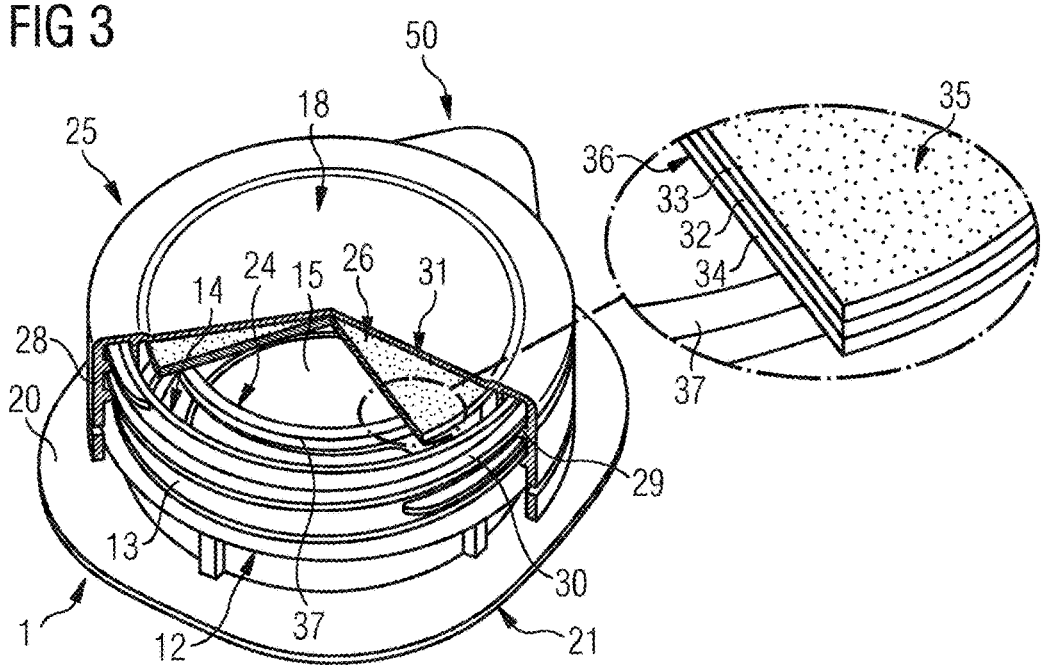
FIG. 3 shows a smaller-scale, partly-sectioned, perspective view of the opening device of FIG. 1.
Figure 4:
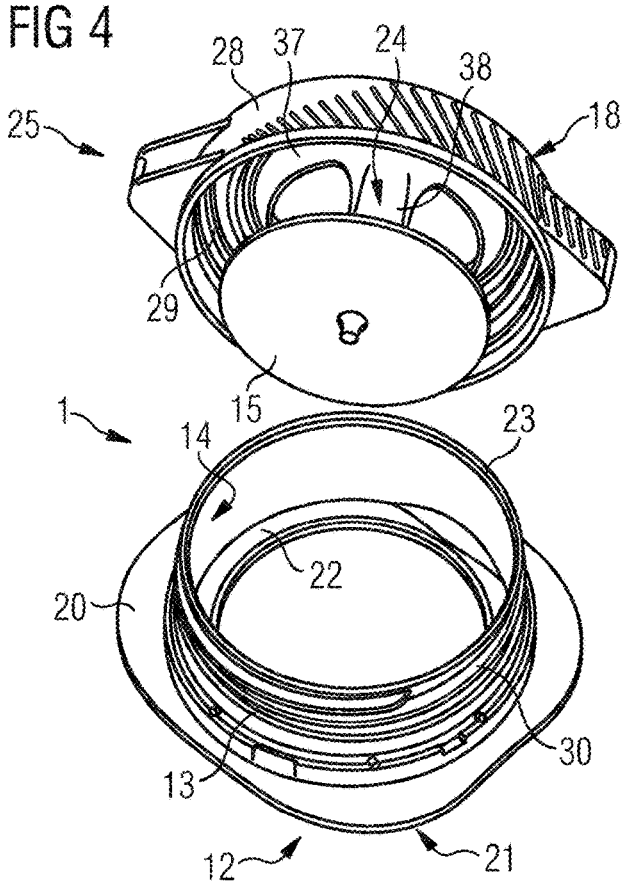
FIG. 4 shows a smaller-scale perspective view of the opening device of FIG. 1 in an open condition.
Figure 5:
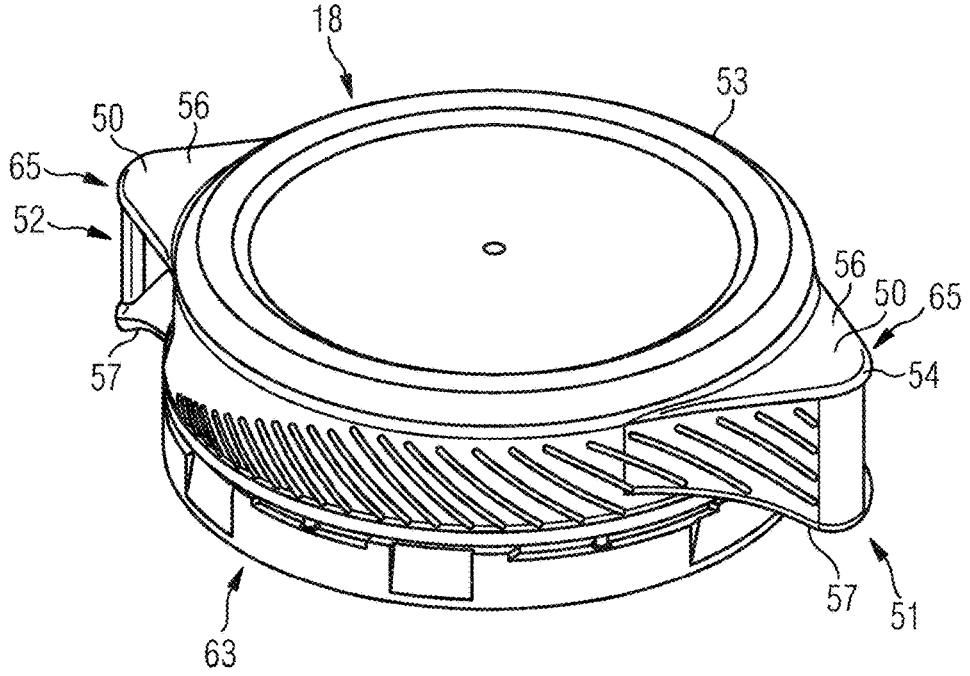
FIG. 5 is a perspective view of a first embodiment of the lid according to the invention.
Figure 6:
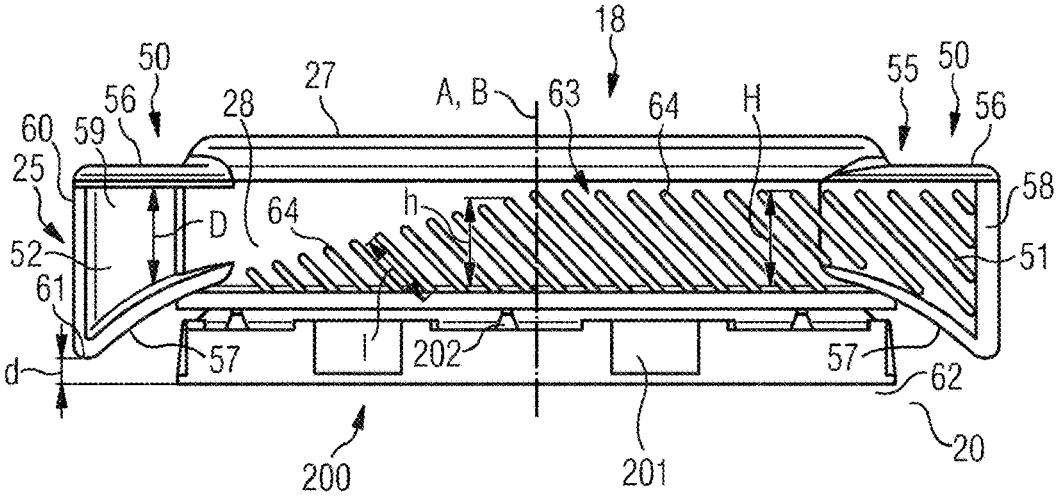
FIG. 6 is a front view of the lid of FIG. 5.
Figure 7:
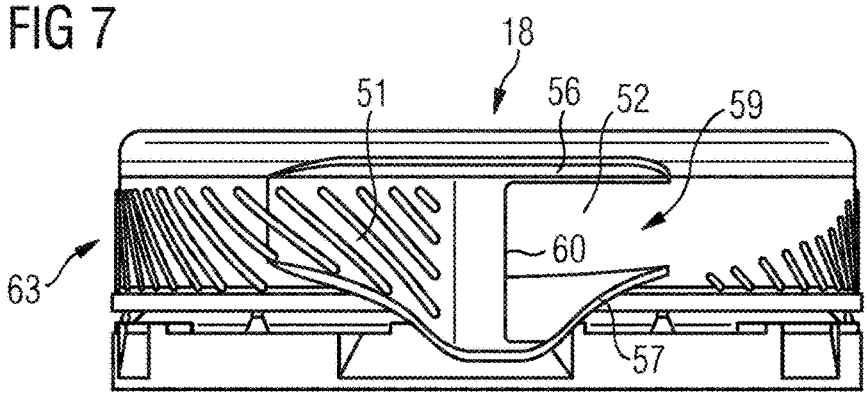
FIG. 7 is a side view of the lid of FIG. 5.
Figure 8:
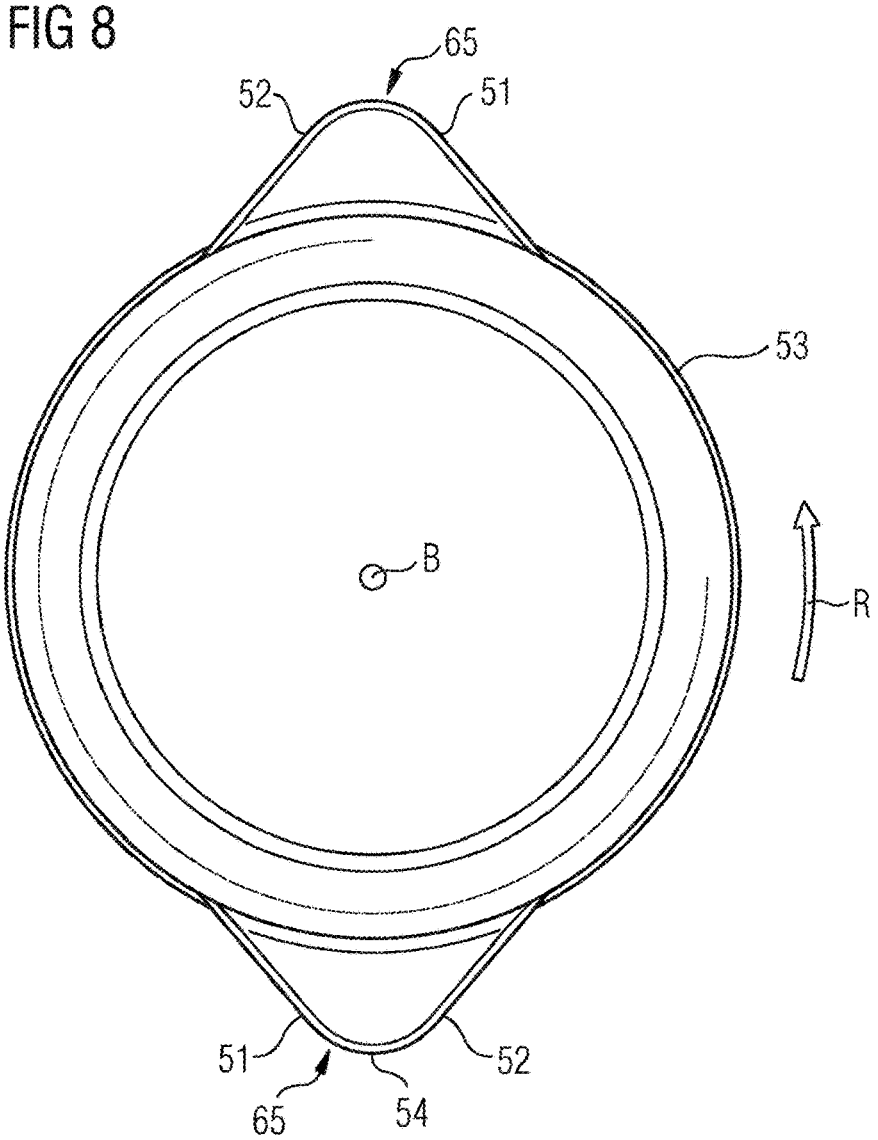
FIG. 8 is a top view of the lid of FIG. 5.
Figure 9:
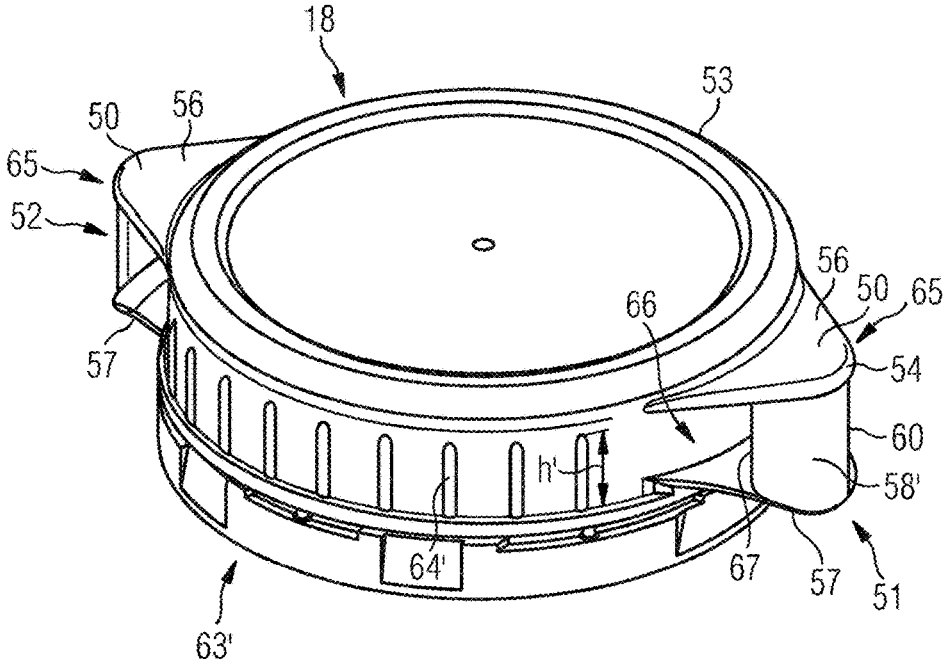
FIG. 9 is a perspective view a second embodiment of the lid according to the invention.
Figure 10:
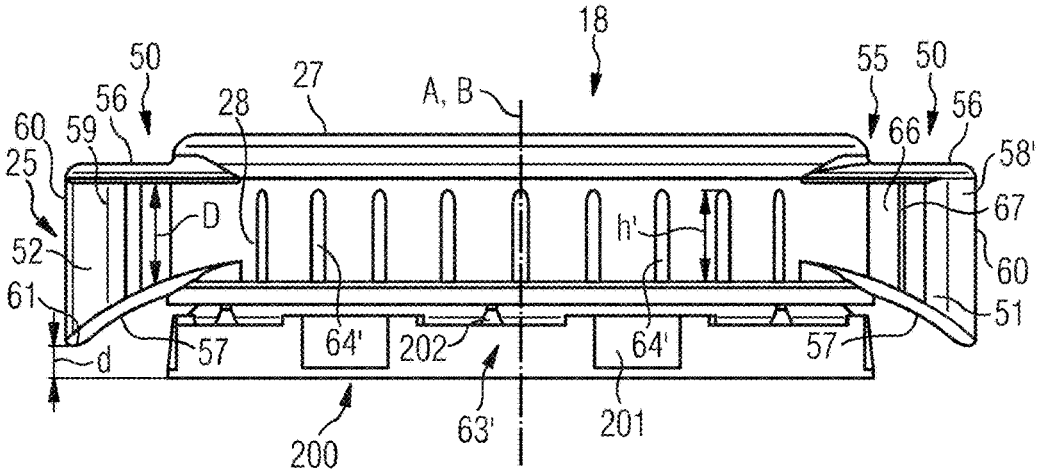
FIG. 10 is a front view of the lid of FIG. 9.
Figure 11:
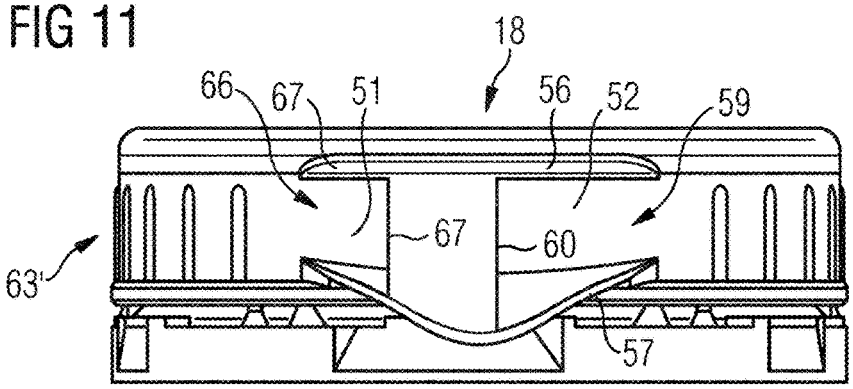
FIG. 11 is a side view of the lid of FIG. 9.
Figure 12:
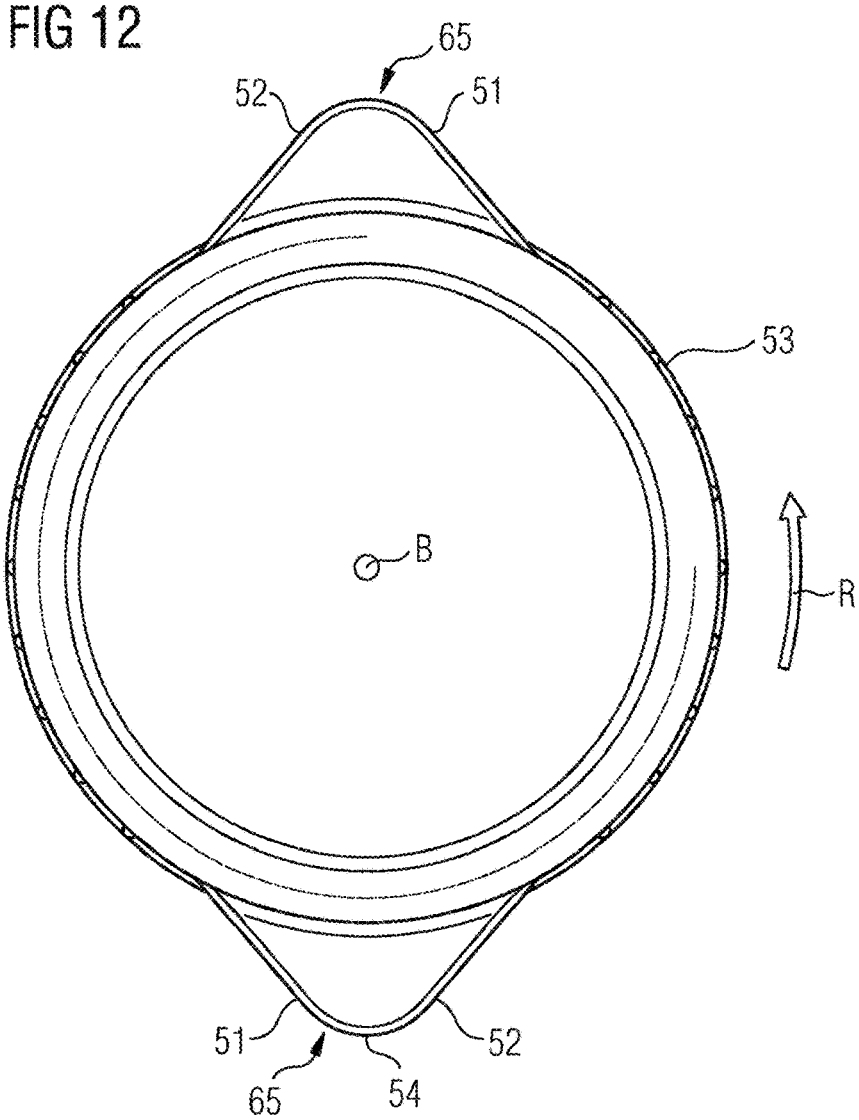
FIG. 12 is a top view of the lid of FIG. 9.

As shown in FIGS. 1, 3 and 4, the pouring spout 12 further comprises an annular flange 20 fixed to the packaging material 3 at the edge of the hole 9. The neck projects axially and integrally from an annular region of the flange 20 radially interposed between an outer edge 21 of the flange 20 itself and the membrane 16.

In practice, the closing element 15 defines a prolongation of the flange 20 inside the pouring spout and closes or seals a first axial end 22 of the pouring spout 12.

The lid 18 seals a second axial end 23, opposite to the first axial end 22, of the pouring spout 12, even after removal—in use—of the closing element 15 and the cover portion 10.

In the embodiment shown in FIGS. 1, 3 and 4 the closing element 15 is advantageously formed in one piece with a protruding portion 24 extending through the pouring opening 14 and welded to the lid 18 far away from the closing element 15. In other words, the protruding portion 24 is welded to the lid 18 at a given, not null, axial distance from the closing element 15.

With reference to FIGS. 1 and 3, the opening device 1 comprises a disk-shaped welding promoting element 26 to connect the lid 18 to the protruding portion 24.

In particular, the lid 18 comprises an end wall 27, closing the pouring opening 14 of the pouring spout 12 at the first axial end 23 thereof, and a side wall 28 cooperating with the outer surface of the neck 13 of pouring spout 12.

The lid 18 is of a screw type and the lateral wall 28 has an inner thread 29 that engages a corresponding outer thread 30 on the neck 13 of the pouring spout 12.

The lid 18 further comprises an annular rib 27*a* axially protruding from the end wall 27 towards the inside of the lid 18 itself and defining a seat 27*b* for receiving the welding promoting element 26.

As shown in FIGS. 1 and 3, the welding promoting element 26 is defined by a multilayer sheet element 31 distinct from the lid 18 and permanently connected to the lid 18.

In the embodiment shown in FIG. 3, the sheet element 31 comprises a layer 32 of conductive material, e.g. an aluminum foil, and at least a first layer 33 and a second layer 34 of heat-sealable plastic material, e.g. polyethylene films, covering both sides of the layer 32. The first layer 33 defines a first face 35 of the sheet element 31 and the second layer 34 defines a second face 36—opposite to the first face 35—of the sheet element 31.

In the embodiment shown, the first face 35 of the sheet element 31 is configured to be welded to the end wall 27 by the heat generated by inducing an electric current in the layer 32. Similarly, the face 36 of the sheet element 31 is configured to be welded to the protruding portion 24 by the heat generated by inducing an electric current in the layer 32.

As shown in FIGS. 1, 3 and 4, the protruding portion 24 comprises an annular body 37, welded to the second face 36 of the sheet element 31, and two legs 38 integrally connecting the annular body 37 to the closing element 15. In particular, the legs 38 have first ends 39, integrally connected to respective diametrically opposite portions of the annular body 37 with respect to axis A, and second ends 40 integrally connected to the closing element 15.

As a possible alternative not shown, the legs 38 may be also not diametrically opposite one another.

As a further possible alternative not shown, the protruding portion 24 may comprise more than two legs 38 angularly spaced from each other.

The lid 18 comprises a body 25 delimited by the end wall 27 and the side wall 28.

As shown in FIGS. 5 to 8, the lid 18 also comprises a tamper evidence device 200 arranged to show if the opening device 1 has been tampered.

The tamper evidence device 200 comprises a tamper ring 201—intended to be connected to the pouring spout 12 in a known manner—and a breakable arrangement, for example a plurality of breakable bridges 202, which are broken during first unscrewing of the lid 18 from the neck 13 of the pouring spout 12, to indicate that the first opening of the package 100 has taken place.

The lid 18 further comprises at least one driving element 50 having a first side 51 arranged to receive the fingers of a user during unscrewing of the lid 18 from the neck 13 of the pouring spout 12 and a second side 52 arranged for receiving the fingers of the user during screwing of the lid 18 on the neck 13 of the pouring spout 12, when the opening device 1 is re-closed after the first opening.

In the embodiment shown, the lid 18 comprises two driving elements 50 positioned at diametrically opposed locations on the body 25.

In another embodiment, not shown, the lid may comprise more than two driving elements 50. In particular, the driving elements 50 may be arranged at a constant angular distance along a peripheral edge 53 of the body 25.

The driving elements 50 have a substantially triangular shape, in plan view. In particular, each of the driving elements 50 is delimited by the first side 51 and the second side 52. The first side 51 and the second side 52 are connected to each other by at and end portion 54, particularly a rounded end portion. The end portion 54 defines a "vertex" 65 of the driving element 50, i.e. of the above mentioned triangular shape, projecting from the body 25.

Each of the driving elements 50 defines an appendix 55 radially projecting from the body 25.

The driving elements 50—being arranged farther away from longitudinal axis B than the side wall 28—act as lever means that allow reduction of the torque required to unscrew the lid 18.

Each driving element 50 is delimited by an upper wall 56 and by a lower wall 57, spaced apart from each other along longitudinal axis B.

The first side 51 is defined by a wall 58 extending—in the direction of longitudinal axis B—between the upper wall 56 and the lower wall 57.

In the embodiment shown in FIGS. 5 to 8, the wall 58 projects from the side wall 28. In other words, the wall 58 is interposed between the side wall 28 and the "vertex" 65 of the driving element 50. In particular, the wall 58 extends from the "vertex" 65 of the driving element 50 and contacts the side wall 28.

The second side 52 is defined by a cavity 59 delimited by the upper wall 56, by the lower wall 57 and by and end edge 60 of the wall 58 extending—in the direction of longitudinal axis B—between the upper wall 56 and the lower wall 57.

The upper wall 56 extends from the side wall 28.

The lower wall 57 extends from the side wall 28.

The lower wall 57 diverges from the upper wall 56 when moving away from the side wall 28. In other words the lower wall 57 and the upper wall 56 are separated by a distance D—measured along longitudinal axis B—that increases when moving away from the side wall 28.

The upper wall 56 is substantially straight.

The upper wall 56 is substantially parallel to the end wall 27. In particular, the upper wall 56 is closer—in a direction parallel to longitudinal axis B—to the tamper evidence device 200 than the end wall 27.

The upper wall 56 is substantially perpendicular to longitudinal axis B.

The lower wall 57 is curved.

The driving elements 50 have a substantially trapezoidal shape, in side view.

Each driving element 50 has an outmost portion 61 defined by the portion of the lower wall 57 that is arranged further away from the side wall 28, i.e. from longitudinal axis B. The outmost portion 61 is arranged at a very small further distance d—measured along longitudinal axis B—from the flange 20 of the opening device 1, i.e. from a top panel of the container 100, when the opening device 1 is applied to the package 100. In particular, the outmost portion 61 is almost aligned with a lowermost border 62 of the lid 18, i.e. a lowermost edge of the tamper ring 201.

The lid 18 comprises a knurling 63 arranged to provide a grip between the fingers of a user and the lid 18 during unscrewing of the lid 18 from the neck 13 of the pouring spout 12.

The knurling 63 is arranged on the side wall 28.

The knurling 63 has a height, measured along longitudinal axis B, which increases in an unscrewing direction R. The unscrewing direction R is the direction according to which the lid 18 is rotated around longitudinal axis B to be unscrewed from the neck 13 of the pouring spout 12.

In the embodiment shown, the height h of the knurling 63 is substantially null close to one of the driving elements 50 and increases up to a maximum height H close to the other one of the driving elements 50. In particular, the height h linearly increases from zero to the maximum height H.

In the embodiment shown, the knurling 63 comprises a plurality of ribs 64 projecting from the side wall 28. The ribs 64 are inclined with respect to longitudinal axis B. A length l of the ribs 24 increases in the unscrewing direction R.

In another embodiment not shown, the knurling 63 comprises a plurality of ribs 64 projecting from the side wall 28. The ribs 64 are substantially parallel to longitudinal axis B. A length l of the ribs 24 increases in the unscrewing direction R.

The length l of the ribs 24 is substantially null close to one of the driving elements 50 and increases up to a maximum height L.

In the embodiment shown, the knurling 63 also extends on the first side 51 of each of the driving elements 50.

With reference to FIGS. 9 to 12 another embodiment of the lid 18 is shown.

The embodiment of FIGS. 9 to 12 is similar to the embodiment of FIGS. 5 to 8 and is described only to the extent it differs from the embodiment of FIGS. 5 to 8. The same numeral references are used for the same parts and components.

In the embodiment of the lid 18 shown in FIGS. 9 to 12 the first side 51 is defined by a wall 58' and a gap 66 is interposed between the wall 58' and the side wall 28. In this case, the wall 58' comprises a further end edge 67 opposite to the end edge 60 and extending—in the direction of longitudinal axis B—between the upper wall 56 and the lower wall 57. The further end edge 67 is arranged at a distance from the side wall 28. In other words, the wall 58' does not project from the side wall 28. The wall 58' extends from the "vertex" 65 of the driving element 50, but does not contact the side wall 28.

In addition, the lid 18 shown in FIGS. 9 to 12 comprises a knurling 63' that is defined by a plurality of ribs 64'.

The ribs 64' projects from the side wall 28.

The ribs 64' are substantially straight and are substantially parallel to longitudinal axis B.

All the ribs 64' have substantially the same height H' measured along longitudinal axis B.

The ribs 64' are substantially equally spaced on the side wall 28.

It is to be noted that, the knurling 63 may be used in connection with the lid 18 shown in FIGS. 9 to 12 and the knurling 63' may be used in connection with the lid 18 shown in FIGS. 5 to 8.

In particular, the knurling 63 inclined with respect to longitudinal axis B may extend on the wall 58' and the knurling 63' parallel to longitudinal axis B may extend on the wall 58.

In actual use, the first opening of the container is obtained by rotating the lid 18 with respect to the pouring spout 12 about longitudinal axis B. At the beginning of the rotation impressed by the user on the lid 18, in particular on the first side 51 of each of the driving elements 50, the legs 38 bend in the direction of rotation, i.e. in the unscrewing direction R, so exerting a pulling action on the closing element 15 at a given point of the annular membrane 16. In other words, due to the presence of the legs 38, the torque exerted on the lid 18 is transformed in a pulling action on the closing element 15, which starts to detach from the pouring spout 12 at a given point along the annular membrane 16.

Upon further rotation, the lid 18 unscrews completely from the pouring spout 12 together with the closing element 15, which remains attached to the lid 18 (see FIG. 4) and therefore fully detaches along the annular membrane 16 from the pouring spout 12 itself.

The user—after first opening of the package 100—may re-close the opening device by screwing back the lid 18 on the pouring spout 12.

It is to be noted that—during first opening of the package 100—the user applies to the lid 18 an unscrewing torque that is required for unscrewing the lid 18 from the pouring spout 12. Such unscrewing torque has to be big enough to break the annular membrane 16.

During re-closing of the package 100 the user applies to the lid 18 a screwing torque that is smaller than the above-mentioned unscrewing torque, since—in this case—there is no need to break the annular membrane 16.

Owing to the fact that the outmost portion 61 is close to the flange 20 the user is prevented from putting his finger between the driving element 50 and the flange 20, i.e. between the lower wall 57 and a panel of the package 100 to which the opening device 1 is applied, and pull the lid 18 instead of unscrewing the lid 18.

Owing to the wall 58, 58' in the first side 51 of the driving element 50—which defines a continuous and easy-to-push surface—the user may apply a rather high torque when unscrewing the lid 18, i.e. when rotating the lid 18 in the unscrewing direction R.

Owing to the cavity 59 in the second side 52 of the driving element 50 the user is prevented, or at least discouraged, to apply a too high torque (that could damage, or even break the lid 18 and/or the pouring spout 12) when screwing the lid 18, i.e. when rotating the lid 18 in a screwing direction, opposite to the unscrewing direction R.

The cavity 59, in fact, does not provide an uninterrupted surface that can be smoothly pushed by the user when screwing the lid. When re-closing the package 100, in fact, the fingers of the user interact with the upper wall 56, with the lower wall 57 and with the end edge 60 of the wall 58, 58', which provide a less comfortable pushing zone, when compared to the wall 58, 58'. During screwing, therefore, the user is not able to apply the same torque he applies during unscrewing. In addition, the user has different tactile feelings when touching the second side 52, i.e. when putting his fingers in the cavity 59, and when touching the first side 51, i.e. when putting his fingers on the wall 58, 58'. This difference in tactile feelings tells the user the direction in which the lid is being rotated and, therefore, the amount of torque needed.

Moreover, the variable height h of the knurling 63 clearly indicates to the user the unscrewing direction R. In this way, the user is prevented from rotating the lid 18 in the wrong direction when opening the package for the first time.

Clearly, changes may be made to the lid as described herein without, however, departing from the scope of protection as defined in the accompanying claims.

In particular, the lid 18 can be welded to the annular body 37, without interposition of the welding promoting element 26. In this case, the welding promoting element 26 is not needed.

In addition, the lid 18 can be used in connection with other kinds of pouring spouts, in particular pouring spouts that are manufactured separately and subsequently applied to an already formed, filled and sealed package.

The invention claimed is:

1. A lid for an opening device (1) for a container (100), comprising a body (25) having a longitudinal axis (B) and provided with a top wall (27) and with a side wall (28) internally provided with a thread element (29) suitable for cooperating with a further thread element (30) of a spout (12) of said opening device (1), said lid (18) further comprising at least one driving element (50) arranged to receive the fingers of a user during unscrewing of said lid (18) from said spout (12) and during screwing of said lid (18) on said spout (12), said at least one driving element (50) being delimited by an upper wall (56) and by a lower wall (57) extending from said side wall (28) and spaced apart from each other along said longitudinal axis (B), said lower wall (57) diverging from said upper wall (56) when moving away from said side wall (28).

2. A lid according to claim 1, wherein said upper wall (56) is substantially straight and said lower wall (57) is curved.

3. A lid according to claim 1, wherein said upper wall (56) is substantially parallel to said end wall (27) and perpendicular to said longitudinal axis (B).

4. A lid according to claim 1, wherein said at least one driving element (50) has an outmost portion (61), defined by the portion of said lower wall (57) that is arranged further away from said side wall (28), which is substantially aligned with a lowermost border (62) of said lid (18).

5. A lid according to claim 4, wherein said lowermost border (62) is an end edge of a tamper ring (201) connected to said body (25) by means of a breakable arrangement (202).

6. A lid according to claim 1, wherein said at least one driving element (50) has a first side (51) arranged to receive the fingers of a user during unscrewing of said lid (18) from said spout (12) and a second side (52) arranged for receiving the fingers of a user during screwing of said lid (18) on said spout (12), said first side (51) being defined by a wall (58; 58') and said second side (52) being defined by a cavity (59).

7. A lid according to claim 6, wherein a gap (66) is interposed between said wall (58') and said side wall (28).

8. A lid according to claim 6, wherein said wall (58) extends from said side wall (28).

9. A lid according to claim 6, wherein said wall (58; 58') extends between said upper wall (56) and said lower wall (57).

10. A lid according to claim 6, wherein said cavity (59) is delimited by said upper wall (56), by said lower wall (57) and by and end edge (60) of said wall (58; 58') arranged further away from said side wall (28).

11. A lid according to claim 6, wherein said side wall (28) comprises a knurling (63) arranged to provide a grip between the fingers of a user and said side wall (28), said knurling (63) having a height (h), measured along said longitudinal axis (B), which increases in an unscrewing direction (R) of said lid (18) from said spout (12) around said longitudinal axis (B).

12. A lid according to claim 11, wherein said knurling (63) comprises a plurality of ribs (64) projecting from said side wall (28), said ribs (64) being inclined with respect to said longitudinal axis (B) and having a length (1) that increases in the unscrewing direction (R).

13. A lid according to claim 1, wherein said knurling (63) comprises a plurality of ribs (64) projecting from said side wall (28), said ribs (64) being substantially parallel to said longitudinal axis (B) and having a length (1) that increases in the unscrewing direction (R).

14. A lid according to claim 11, wherein said knurling (63) also extends on said first side (51).

15. A lid according to claim 1, wherein said at least one driving element (50) defines an appendix (55) radially projecting from said body (25).

16. A lid according to claim 1, wherein said lid (18) comprises two driving elements (50) positioned at diametrically opposed locations on said body (25).

17. A lid according to claim 2, wherein said upper wall (56) is substantially parallel to said end wall (27) and perpendicular to said longitudinal axis (B).

18. A lid according to claim 2, wherein said at least one driving element (50) has an outmost portion (61), defined by the portion of said lower wall (57) that is arranged further away from said side wall (28), which is substantially aligned with a lowermost border (62) of said lid (18).

19. A lid according to claim 3, wherein said at least one driving element (50) has an outmost portion (61), defined by the portion of said lower wall (57) that is arranged further away from said side wall (28), which is substantially aligned with a lowermost border (62) of said lid (18).

20. A lid according to claim 2, wherein said at least one driving element (50) has a first side (51) arranged to receive the fingers of a user during unscrewing of said lid (18) from said spout (12) and a second side (52) arranged for receiving the fingers of a user during screwing of said lid (18) on said spout (12), said first side (51) being defined by a wall (58; 58') and said second side (52) being defined by a cavity (59).

* * * * *